United States Patent [19]

Massa

[11] 3,967,260

[45] June 29, 1976

[54] INTRUSION ALARM SYSTEM WITH IMPROVED AIR TURBULENCE COMPENSATION

[75] Inventor: Donald P. Massa, Cohasset, Mass.

[73] Assignee: Fred M. Dellorfano, Jr. and Donald P. Massa, Trustees of the Stoneleigh Trust u/d/t Dec. 4, 1973, Cohasset, Mass.

[22] Filed: July 8, 1974

[21] Appl. No.: 486,673

[52] U.S. Cl. ..... 340/258 A; 340/1 R

[51] Int. Cl.[2] ..... G08B 13/16

[58] Field of Search ..... 340/258 A, 258 B, 1 R, 340/3 D; 343/7.7

[56] References Cited

UNITED STATES PATENTS

| | | | |
|---|---|---|---|
| 2,767,393 | 10/1956 | Bagno | 340/258 A |
| 2,791,756 | 5/1957 | Wood et al. | 340/3 D |
| 3,202,960 | 8/1965 | Galbraith | 340/3 D |
| 3,629,812 | 12/1971 | Amato | 340/1 R |

*Primary Examiner*—David L. Trafton

[57] ABSTRACT

A comprehensive analysis of the effect of air turbulence on the acoustic performance of an ultrasonic intruder alarm system indicates that air turbulence does not cause Doppler frequency shifts in the received signal in the frequency region 2 – 100 Hz, as has been universally assumed in prior art systems but that air turbulence can only produce amplitude modulations in the received signal over this frequency region. It is also disclosed that changes in air velocity, or accelerations of the air flow, cause only very low Doppler frequency shifts in the signal, below 2 Hz for a 20 kHz carrier, and only moving targets can produce higher Doppler frequency shifts. A processing system is disclosed which is immune to false alarms in the presence of air turbulence without sacrificing threshold sensitivity and without introducing long time delays in the signal processing circuit as has been necessary in prior art systems. The disclosed signal processing system removes the amplitude modulation from the received signal and then discards all very low Doppler frequency shifts below approximately 5 Hz thereby completely eliminating any effect of air turbulence on the operation of the system. Doppler shift frequencies, which can only be produced by moving targets, are utilized to activate the alarm.

10 Claims, 4 Drawing Figures

INTRUSION ALARM SYSTEM WITH IMPROVED AIR TURBULENCE COMPENSATION

This invention is related to co-pending application, Ser. No. 378,562, filed July 12, 1973, now U.S. Pat. No. 3,828,336, and is concerned with an ultrasonic intrusion detection system in which a moving target is detected by means of a Doppler shift in the transmitted ultrasonic frequency caused by the motion of the target. More specifically, this invention is concerned primarily with the elimination of false alarms which generally occur in the presence of air turbulence.

The principle of operation of an ultrasonic intrusion detection system is well known and is more fully described in co-pending application Ser. No. 378,562. Basically, the space to be protected is insonified by an acoustic signal generated by a transmitting transducer, and the sonic energy, after being reflected from various surfaces and objects within the room, is picked up by a microphone. In the absence of any motion within the room the frequency of the received signal will be equal to the frequency of the transmitted signal. If a moving object enters the insonified room, the energy reflected by the moving target will be shifted in frequency due to Doppler and a comparison of the received and transmitted frequencies will then indicate the presence of the moving target.

A serious problem confronting all prior art ultrasonic intrusion detection systems is false alarms which occur because of ambient variables, particularly false alarms which result from air motion within the space being protected. Several attempts have been made for reducing false alarm rates due to air turbulence in ultrasonic detection systems by incorporating circuit modifications to make the system selectively more sensitive to the changes caused by a moving target as compared to changes produced by air currents. Several different signal processing procedures have been described in the prior art for reducing false alarms due to air turbulence. A comprehensive review of the prior art procedures are described in co-pending application Ser. No. 378,562, where U.S. Pat. Nos. 2,794,974; 3,111,657; 3,638,210 and 3,665,443, which are representative of the state of the art, are thoroughly discussed and the data processing techniques therein disclosed are fully examined.

The various procedures described in the prior art patents for reducing false alarms due to air turbulence all depend for their operation on different methods for processing the same basic data originally shown by Bagno et al. in FIG. 3 of U.S. Pat. No. 2,749,974, which is a graphic representation of the r.m.s. amplitude vs. frequency spectrum of the acoustic signals, averaged over 30 sec periods, which appear in the microphone output in the presence of various air turbulence type phenomena in comparison to the frequency spectrum of the signals which appear when a human target is walking through the insonified area.

There is a basic error in the technical explanation discussed in U.S. Pat. No. 2,794,974 which assumes that air turbulence produces a Doppler frequency shift in the signal. This misconception has not been noted or corrected in any of the prior art patents which are discussed in the co-pending application. They have all relied on the experimental data as presented in FIG. 3 of U.S. Pat. No. 2,749,974 which shows the relative frequency vs. amplitude distribution in the long time averaged energy spectrum which is found in the rectified output of the received signal in the presence of air turbulence and also for a moving target. The experimental data shows that in general the energy spectrum due to air turbulence falls off gradually with increasing frequency between 2 and 100 Hz, whereas the energy spectrum is more uniformly distributed over the same frequency range for a moving human target. Although U.S. Pat. No. 2,749,974 mistakenly assumes that air turbulence causes a Doppler shift in frequency to account for the energy spectrum data shown in FIG. 3 of the patent, and the error was not recognized in any of the subsequent patents discussed in the co-pending application, the experimental data showing the frequency distribution of the averaged rectified output signals is correct, and the subsequent inventions in the U.S. Patents which are fully discussed in the co-pending application achieved their objectives in reducing the false alarm rates due to air turbulence in spite of the erroneous theory which accounted for the presence of the air turbulence generated signals. The reduction in false alarm rates was achieved by sacrificing system detection capability as discussed in the co-pending application.

This invention describes a novel method for eliminating false alarms due to air turbulence without reducing the detection capability of the system and is based on a complete understanding of the effect of air turbulence on the acoustic system. All prior art disclosures previous to co-pending application Ser. No. 378,562 have assumed that if the air in a room is moving that large Doppler shifts will occur in the frequency of the transmitted signal as illustrated in the experimental data presented in FIG. 3 of U.S. Pat. No. 2,794,974. This assumption is erroneous because the moving air will only cause variations in the velocity of sound (the air velocity is added to the sound velocity) which in turn causes large variations in the standing wave pattern in the room which results in large amplitude variations in the received pressure wave at the microphone, which is the sum of all the pressure waves arriving at the microphone from all reflecting objects as well as the pressure wave arriving by the direct transmission path between the transmitter and receiver. These variations in the standing wave pattern caused by air motion produces large amplitude variations in the received acoustic signal and appears as an amplitude modulation of the carrier frequency. In the demodulation process used in U.S. Pat. No. 2,794,974 the low frequency signals between 2 –100 Hz as shown in FIG. 3 are actually present. These signals are present not because of the erroneous explanation in the patent that they result from a Doppler shift caused by air turbulence but they are present because of the amplitude modulation of the carrier frequency by the standing wave pattern variations in the room caused by air turbulence.

Applicant's invention is based on a fundamental departure from the erroneous assumption made in the prior art references which all assume the generation of a wide band of low frequency Doppler shift signals in the received acoustic signal in the presence of air turbulence. Applicant has found that this assumption is incorrect and that air motion, even at high velocities, causes only amplitude modulations of the received acoustic signal in the approximate frequency range 2–100 Hz. This invention applies these findings to the design of a new ultrasonic intruder alarm system that achieves greatly increased reliability over prior art systems because of its immunity to false alarms in the presence of air turbulence.

The primary object of this invention is to improve the reliability of ultrasonic intruder alarm systems.

Another object of this invention is to greatly reduce false alarm rates in ultrasonic alarm systems in the presence of air turbulence without reducing the sensitivity of the system.

A still further object of this invention is to greatly reduce false alarm rates in ultrasonic alarm systems in the presence of air turbulence without introducing long time delays in the detection circuit.

Another object of this invention is to greatly reduce false alarm rates in ultrasonic intruder alarm systems in the presence of air turbulence by providing an improved signal processing method which removes all amplitude modulation from the received signal before utilizing the signal for activating an alarm.

A further object of this invention is to simplify the signal processing in the system thereby reducing the complexity of the system with corresponding increased reliability and decreased manufacturing cost.

These and other objects, features and advantages of the invention will become more fully apparent from the following detailed description taken in conjunction with the accompanying drawings in which.

Figure 1:
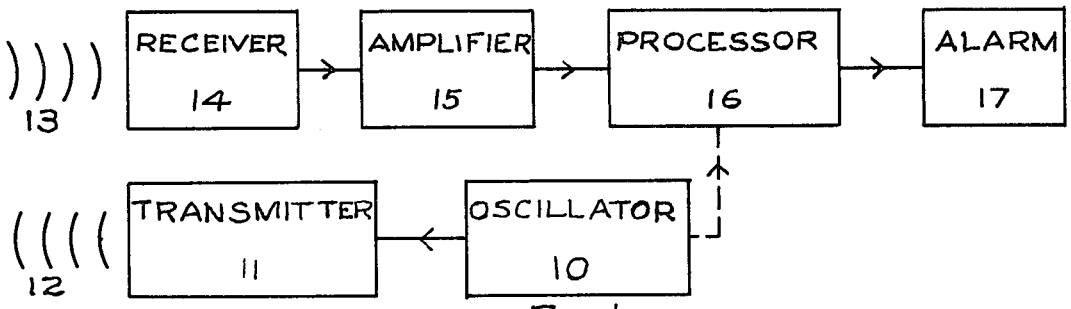
FIG. 1 is a block diagram illustrating a basic ultrasonic intrusion alarm system utilizing the teachings of this invention.

Before discussing the figures, a mathematical analysis will be presented to support Applicant's contention that air turbulence does not produce Doppler frequency shifts in the range 2–100 Hz as is erroneously assumed in the prior art references. It will be shown that air turbulence produces low frequency amplitude modulation of the carrier over the frequency range 2–100 Hz and that only changes in air velocity, or accelerations of the air current, produce a Doppler shift in the received signal and that these Doppler shifts are less than a few Hz for a typical ultrasonic intruder alarm system. It is this fundamental difference in the basic understanding of the effect of air turbulence on the received acoustic signal that is applied by Applicant in creating the novel processing system disclosed in this invention for the elimination of false alarms due to air turbulence.

GENERAL ANALYSIS OF AN ULTRASONIC INTRUSION ALARM SYSTEM

A typical ultrasonic intruder alarm system includes a number of transmitting and receiving transducers arranged in a fixed spatial distribution inside the room to be protected. The transmitter sends out sound waves which are reflected from the walls, floor and from any other objects within the room and eventually arrive at the receiver. The pressure wave appearing at the receiver will be the summation of all the pressure waves arriving from all reflecting objects as well as the pressure wave arriving by any direct transmission path. The receiver pressure wave may be represented by the equation $$p(t) = \sum_i A_i e^{j[\omega_c t - \frac{\omega_c R_i(t)}{c_i(t)}]} \quad (1)$$

where:

$p(t)$ is the pressure wave at the receiver $A_i$ is the amplitude of the $i^{th}$ component $\omega_c$ is the transmitted frequency $R_i(t)$ is the total distance traversed by the $i^{th}$ component of the pressure wave in travelling from the transmitter to the receiver. This distance becomes a function of time if the transmitter, receiver, or reflector is moving $c_i(t)$ is the speed of sound along the path of the $i^{th}$ component of the pressure wave which becomes a function of time in the presence of air turbulence Since the received pressure wave in equation (1) is a summation, it follows that the maximum frequency shift occurring in $p(t)$ is the same as the frequency shift present in the component term which has the maximum shift. This allows an analysis of the maximum frequency shift in $p(t)$ introduced by air turbulence to be carried out by analyzing the single term containing this maximum frequency shift. If $p_1(t)$ is this term, then the remaining terms in $p(t)$ can be ignored and an analysis can then be made on the equation $$p_1(t) = A_1 e^{j[\omega_c t - \frac{\omega_c R_1(t)}{c_1(t)}]} \quad (2)$$

The instantaneous frequency of $p_1(t)$ is equal to the time derivative of the phase term in (2) which is given by $$\omega(t) = \frac{d}{dt}[\omega_c t - \frac{R_1(t)}{c_1(t)}\omega_c] \quad (3)$$

$$\omega(t) = \omega_c - \omega_c[\frac{R_1'(t)}{c_1(t)} - \frac{R_1(t)c'(t)}{c_1^2(t)} \quad (4)$$

where:

$\omega(t)$ is the instantaneous frequency of $p_1(t)$ $R_1'(t)$ is the time derivative of $R_1(t)$ $c_1'(t)$ is the time derivative of $c_1(t)$ As can be seen by equation 4, if $R_1(t)$ and $c_1(t)$ are constants their derivatives will be zero and the instantaneous frequency will be $\omega_c$. If, however, $c_1(t)$ or $R_1(t)$ varies as a function of time, such as would occur in the presence of air turbulence or in the presence of a moving target, there will be a frequency shift from $\omega_c$ in the received signal. The amount of frequency shift is given by $$\Delta\omega = \omega(t) - \omega_c = -\omega_c [\frac{R_1'(t)}{c_1(t)} - \frac{R_1(t)c_1'(t)}{c_1^2(t)}] \quad (5)$$

where:

$\Delta\omega$ is the frequency shift from the carrier, $\omega_c$, in radians/sec therefore:

$$\Delta f = -f_c [\frac{R_1'(t)}{c_1(t)} - \frac{R_1(t)c_1'(t)}{c_1^2(t)}] \quad (6)$$

where:

$f_c$ is the carrier frequency in Hz
$\Delta f$ is the frequency shift from the carrier in Hz

FREQUENCY VARIATIONS IN THE RECEIVED SIGNAL CAUSED BY A MOVING TARGET IN A STILL ROOM

If there is no air turbulence in a room and only a moving target is present, the sound velocity for all received pressure waves will be constant but the path length over which the received pressure wave from the moving target travels will be a function of time. Therefore, $$c_1(t) = c \tag{7}$$

$$c_1'(t) = 0 \tag{8}$$

and equation (6) becomes $$\Delta f = -(f_c/c)\, R_1'(t) \tag{9}$$

If a reflecting target is moving at a given rate, the path length over which the sound wave travels from the transmitter to the receiver can actually be changing at a higher rate which could become as much as twice the rate of the target's motion for the special case in which the target is moving directly toward or directly away from the transmitting and receiving transducers when both transducers face the moving target. In a typical acoustic alarm system a carrier frequency $f_c$ is usually chosen in the neighborhood of 20 kHz. The sound velocity in air is approximately 1100 ft/sec. The slowest speed at which it is desired to detect a moving target is about 1 ft/sec; therefore, if a target is moving towards the receiver at a rate of 1 ft/sec, the path length of the reflected sound arriving at the receiver is decreasing at a maximum rate of 2 ft/sec which may be expressed as $$R_1'(t) = -2 \text{ ft/sec} \tag{10}$$

Substituting (10) in (9), $$\Delta f = -(20{,}000/1100)\,(-2) = 36 \text{ Hz} \tag{11}$$

If the target is moving away from the receiver, $$R_1'(t) = 2 \text{ ft/sec} \tag{12}$$

$$\Delta f = -36 \text{ Hz} \tag{13}$$

ANALYSIS OF FREQUENCY VARIATIONS IN THE RECEIVED SIGNAL CAUSED BY AIR TURBULENCE ALONE

In a room where there is no target motion all the path lengths over which the reflected sound travels will remain constant. However, in the presence of air turbulence, the sound velocity will be a function of time. Therefore, $$R_1(t) = R \tag{14}$$

$$R_1'(t) = 0 \tag{15}$$

Substituting (14) and (15) in (6), $$\Delta f = f_c\, R\, \frac{c_1'(t)}{c_1^2(t)} \tag{16}$$

The maximum frequency shift $\Delta f$ occurs when $$\frac{|c_1'(t)|}{c_1^2(t)}$$

is maximum, and R is maximum. In a typical ultrasonic installation the maximum value of R over which the acoustic signal is required to travel is approximately 50 ft and the maximum rate of change of air velocity $c_1'(t)$ under conditions of intense turbulence would not exceed 2 ft/sec$^2$. Since $c_1(t)$ is approximately 1100 ft/sec and remains approximately constant even in the presence of extreme air turbulence, $$c_1^2(t) = 1.21 \times 10^6\ ft^2/\text{sec}^2 \tag{17}$$

and the maximum frequency shift becomes $$\Delta f = f_c\,(50)\left(\frac{2}{1.21 \times 10^6}\right) = 8.26 \times 10^{-5} f_c \tag{18}$$

If $f_c$ equals 20 kHz, then $$\Delta f = 20{,}000\,(8.26 \times 10^{-5}) = 1.6 \text{ Hz} \tag{19}$$

Comparing equations 11, 13 and 19, it can be seen that the amount of frequency shift caused by relatively intense air turbulence is less than 2 Hz which is more than an order of magnitude below the frequency shift of 36 Hz in equations 11 and 13 caused by a target moving at a slow rate of 1 ft/sec. Even for systems employing a higher ultrasonic frequency of say 50 kHz the maximum frequency shift due to air turbulence is only 2½ times the value in equation 19 or 4 Hz.

DISCUSSION OF FREQUENCY SHIFTS CAUSED BY AIR TURBULENCE

Figure 3:
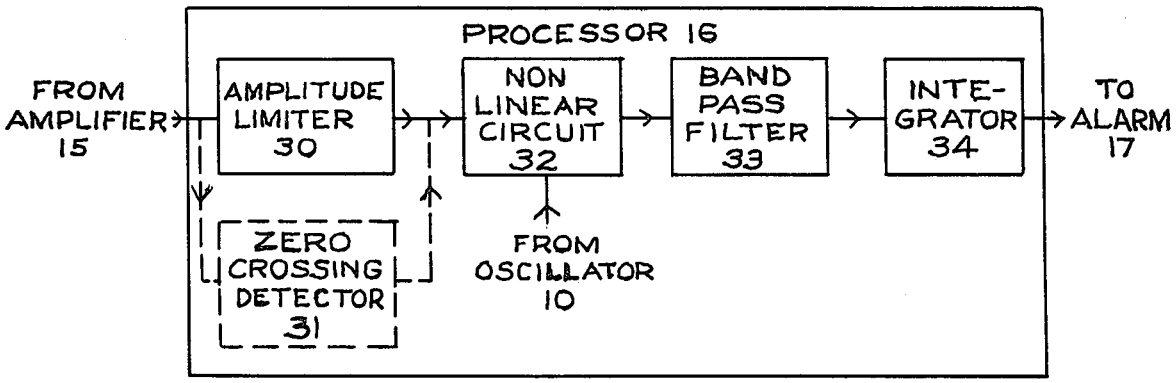
FIG. 3 is a block diagram illustrating a modified FM processor which simplifies the signal processing method for achieving the objects of this invention.

All of the prior art has made use of the experimental data originally disclosed in FIG. 3 of U.S. Pat. No. 2,749,974, which indicated that air turbulence introduced frequency components in the received ultrasonic signal which differed from the carrier frequency by as much as 100 Hz. It was also assumed in all the prior art patents discussed in the co-pending application that these high-frequency components resulted from a true Doppler shift of the carrier caused by the presence of air turbulence. Equation 19 shows that this assumption is erroneous and that the magnitude of the true frequency shift as produced even by intense air turbulence is actually less than 2 Hz when using a 20 kHz acoustic signal, and it would be less than 5 Hz when using a 50 kHz signal. This means that the previously observed high-frequency components between 5 and 100 Hz that are found in the rectified output of the received signal in the presence of air turbulence are actually caused by the amplitude modulation of the carrier pressure wave, and are not the result of a Doppler frequency shift as universally assumed in the prior art.

The high-frequency rate of change of the amplitude modulation (between 5 and 100 Hz) in the presence of air turbulence is caused by the many different sound reflections which arrive at the receiver in rapidly changing phase relationships as the instantaneous sound speed varies along each path. Because of the fundamental understanding disclosed in this invention that air turbulence cannot produce Doppler frequency shifts in the 5–100 Hz region, it becomes possible to totally discriminate against false alarms due to air turbulence by removing the amplitude modulation in the received signal and then processing only the true frequency shifts that remain in the signal. This is basically the novel feature of this invention.

Once the amplitude modulation due to air turbulence is eliminated from the received signal as proposed in this invention all that will be left in the signal is a maximum frequency shift of less than approximately 2 Hz caused by air turbulence, as indicated in equation 19, or less than 5 Hz frequency shift if the system employs ultrasonic frequencies as high as 50 kHz, plus any real Doppler frequency shift as caused by a moving target which will be more than an order of magnitude greater, as shown in equations 11 and 13. After removing the amplitude modulation from the received signal, the presence of any true frequency shift due to the moving target Doppler may be simply detected as is commonly accomplished in conventional FM processing systems. Since the conventional FM demodulator is generally required to produce an output which varies linearly with input frequency, and since this requirement is not necessary in the intruder alarm system which only requires that the output indicate that the change in frequency from the carrier exceeds a specified value, it is possible to employ a modified FM processing system which is simpler than the standard FM system.

GENERAL DESCRIPTION OF ULTRASONIC INTRUDER ALARM SYSTEM

FIG. 1 is a block diagram illustrating an intrusion alarm system which utilizes the teachings of this invention. An oscillator 10 generates a signal which is connected to the transmitting transducer 11. In the case of a large installation where several transducers may be employed to adequately cover the area, transmitting transducer 11 may be one of several transducers connected in parallel. An acoustic signal 12 is produced by the transducer 11, and after it is reflected by any stationary or moving target, it is received by the receiving transducer 14. The received signal 13 is the algebraic sum of all the reflected pressure waves plus the direct path pressure wave arriving at the receiving transducer 14. The characteristic of the received signal 13 is expressed by the relationship shown in equation 1. The received signal 13 is converted to an electrical signal by the transducer 14, and is then amplified in amplifier 15, after which it is fed into a processor 16. If the processor is one of the type which requires a reference signal corresponding to the carrier frequency, the reference signal is provided by the oscillator 10 as illustrated by the dotted line between oscillator 10 and processor 16.

The processor 16 performs the basic functions described in this invention. First, the amplitude modulation is effectively removed from the received signal, then the remaining signal is separated into two frequency groups. One group includes the lower frequency components below approximately 5 Hz which may be caused by air turbulence, as described above, and are therefore discarded. The second group includes the higher frequency components which are very much greater than 5 Hz, which are produced only by moving targets. Only the higher frequency signals are utilized to activate the alarm circuit 17 to indicate the presence of a moving target in the area and completely discriminate against activation of the alarm circuit by the presence of air turbulence in the area.

The processor 16 may also include an integrator or any other well known time delay means to require the higher frequency signals to be present for a specified interval of time before the alarm circuit is activated in order to prevent false alarms that might be caused by transient signals introduced into the system.

Several different embodiments of processor 16 will be described which utilize well known circuit concepts for accomplishing the novel signal processing disclosed in this invention; namely, effectively remove amplitude modulation from the received signal and separate the remaining low-frequency shifted signals caused by air turbulence from the true Doppler higher frequency shifted signals caused by a moving target. The circuit techniques to be described are all well known in the electronic art and are not part of this invention. This invention is only concerned with the novel processing system which performs the function of first, eliminate amplitude modulation from the received signal; second, separate any remaining frequency shifted signals present into a low-frequency group below 5 Hz and a high-frequency group above 5 Hz; and third, use the signal in the high-frequency group to activate the alarm circuit 17.

CONVENTIONAL FM DETECTOR USED AS SIGNAL PROCESSOR

Figure 2:
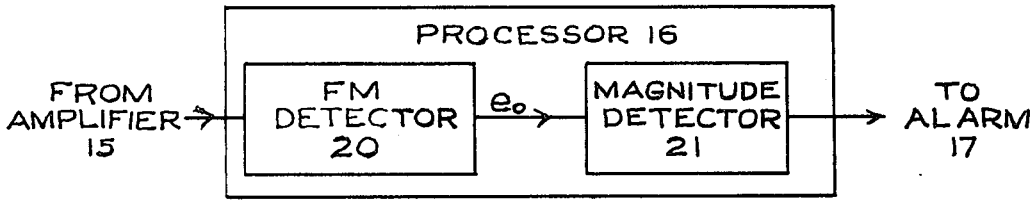
FIG. 2 is a block diagram illustrating the use of a conventional FM processor for achieving the objectives of this invention.

FIG. 2 is a block diagram illustrating the use of a standard FM detector in the processor of FIG. 1 as one method for accomplishing the objectives of this invention. The FM detector 20, which may be any one of the well known types such as, for example, the phase lock demodulator described on page 420 in the textbook "Operational Amplifiers" by Graeme, Tobey and Huelsman, published by McGraw-Hill, 1971, eliminates the effect of the amplitude modulation of the received signal and produces an output voltage $e_o$ which is proportional to the difference in frequencies between the received signal and the carrier. The voltage $e_o$ is positive if the signal frequency is greater than the carrier frequency and negative if the signal frequency is less than that of the carrier. In the presence of air turbulence, the magnitude of $e_o$ will fluctuate over relatively small values corresponding to frequency shifts of magnitude less than 5 Hz. For frequency shifts of magnitudes greater than 5 Hz, such as is produced only by true moving targets, the magnitude of $e_o$ increases in proportion to the amount of Doppler frequency shift caused by the moving target.

In order to detect the presence of a true moving target, the output voltage $e_o$ from the FM detector 20 is fed into a magnitude detector 21 which is set to produce an output voltage only when the magnitude of $e_o$ exceeds a preset value corresponding to a frequency shift of a magnitude greater than approximately 5 Hz. This means that the presence of air turbulence signals will be ignored, and only true moving targets will be detected because only a moving target produces a true frequency shift magnitude greater than 5 Hz.

The magnitude detector 21 may employ any of several well known circuits for accomplishing its function; for example, a full wave rectifier, followed by a Schmitt trigger.

SIMPLIFIED PROCESSOR FOR DETECTING FM SIGNALS

As previously mentioned, it is not necessary to use a standard FM detector in the new proposed signal processing system for avoiding false alarms due to air turbulence. A simplified FM processor can be built, as illustrated in the block diagram in FIG. 3. In this modified system the output from amplifier 15 is fed either into an amplitude limiter 30, such as, for example, a pair of back-to-back diodes as is well known in the art, or alternately, as shown by the dotted lines, into a zero-crossing detector 31 employing a Schmitt trigger as is also well known in the art.

Either of these alternate methods will produce an output signal of constant amplitude whose frequency is equal to the instantaneous frequency of the received acoustic signal 13. The output signal from either 30 or 31 together with the oscillator signal are fed into a non-linear circuit 32, which may be a conventional AM detector.

The output signal from 32 is fed to a band-pass filter 33 whose low-frequency cut-off is set at approximately 5 Hz to reject all frequency components in the signal that could be caused by air turbulence, thus making the system immune to false alarms due to air turbulence. The high frequency cut-off is set at a value between approximately 100 – 200 Hz. The presence of any frequency components above 5 in the output signal from 32 will be recognized as a true moving target and is used to activate the alarm circuit 17. An integrator 34 may be included between the band-pass filter 33 and the alarm circuit 17 to eliminate false alarms due to transients as previously described.

DIGITAL PROCESSING SYSTEM

Figure 4:
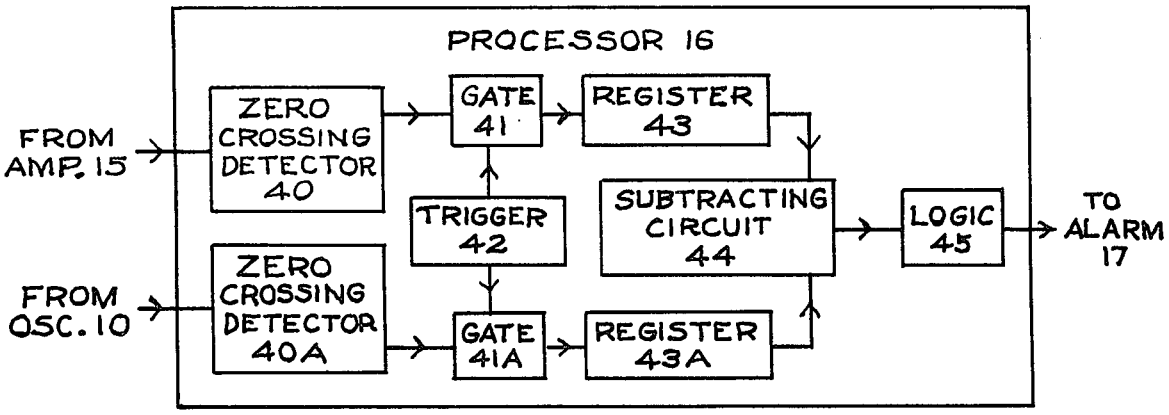
FIG. 4 is a block diagram illustrating a modified FM processing method for achieving the objectives of this invention with a digital electronic processing system.

FIG. 4 shows a block diagram illustrating one method for employing conventional digital techniques in the processor 16. The signal from amplifier 15 is fed into a zero-crossing detector 40 whose output will be a square wave with a frequency equal to the instantaneous frequency of the received acoustic signal 13. A signal from oscillator 10 is connected to another zero-crossing detector 40A; however, if oscillator 10 is a square wave oscillator, the zero-crossing detector 40A may obviously be omitted. The square wave output signals from the zero-crossing detectors 40 and 40A are fed respectively into gate 41 and 41A, and from the gates to registers 43 and 43A, as shown. The gates 41 and 41A are opened and closed simultaneously by the common trigger circuit 42. During the period that the gates are open, the number of zero crossings from detectors 40 and 40A will be accumulated in registers 43 and 43A, and will correspond to the frequencies of the received acoustic signal 13 and the oscillator signal, respectively.

After the gates are closed, the two registers are subtracted one from the other by any well known conventional subtracting circuit 44. The output from 44, which is proportional to the frequency difference between the oscillator frequency and the received acoustic signal 13, is fed into logic circuit 45. The output from logic circuit 45 is connected to alarm circuit 17. If the received acoustic signal 13 is of the same frequency as the signal from the oscillator 10, the output of 44 will be zero, and the logic circuit will not activate the alarm. If only air turbulence is present in the room, the output of 44 will correspond to a value of frequency shift of less than 5 Hz, which is not sufficient for the logic circuit 15 to activate alarm circuit 17. If a moving target is present, the output of 44 will be very much greater than the value corresponding to 5 Hz, and this greater output from 44 will be sufficient for the logic circuit to activate alarm circuit 17. In order to provide discrimination against false alarms due to transient signals, the logic circuit 45 may be designed to require the presence of the greater output from 44 for several consecutive triggerings before activating alarm circuit 17.

The three different signal processing means illustrated in FIGS. 2, 3, and 4 are but a few of many which would readily come to mind to any one skilled in the electronic art for achieving the fundamental requirements of this invention; namely, that the processor must first effectively eliminate any amplitude modulation present in the received signal; it must then detect the presence of any frequencies in the received signal that are different from the transmitted frequency; it must discard all signals whose frequency differences are less than 5 Hz from the transmitted frequency; and, finally, it must utilize any remaining higher frequency signals to activate the alarm circuit.

This invention has disclosed that after removing amplitude modulation from the received signal, the maximum frequency shift remaining in the signal which can be caused by air turbulence is less than 5 Hz. The presence of a true moving target will produce Doppler frequency shifts that are more than an order of magnitude greater than the true frequency shifts caused by air turbulence; therefore, it is easily possible to distinguish the two widely separated frequency regions and design a processor which totally eliminates false alarms due to air turbulence without changing the threshold sensitivity of the system or adding long time averaging circuits, thereby overcoming the limitations inherent in prior art ultrasonic intruder alarm systems.

While there have been shown and described several specific embodiments of the present invention, it will of course be understood that various modifications and alternatives may be made without department from the true spirit and scope of the invention. Therefore the appended claims are intended to cover all such modifications and alternative constructions as fall within their true spirit and scope.

I claim:

1. In an intrusion alarm system, means for radiating a signal at a predetermined frequency into a space, means for receiving the signal as it is reflected from objects within the space, the received signal having a frequency differing from that of the radiated signal by amounts corresponding to the rates of movement of said objects, the received signal also having amplitude modulations caused by phenomena other than moving objects, signal processing means for processing said received signal, said signal processing means including means for first effectively eliminating amplitude modulations in the received signal, said means for eliminating amplitude modulations in the received signal includes a zero crossing detector, said signal processing means also including additional means for recognizing frequency shifts between said radiated signal and said received signal, said signal processing means also including means for separating said frequency shifts in said received signal into a low-frequency region and a high-frequency region, and signal detection means for recognizing the presence of a signal when it appears in said high-frequency region.

2. The invention in claim 1 further characterized in that said radiated signal is an ultrasonic acoustic signal.

3. The invention in claim 2 further characterized in that said ultrasonic signal lies in the approximate frequency range 20 – 50 kHz.

4. The invention in claim 3 further characterized in that said low frequency region includes frequencies below approximately 5 Hz and still further characterized in that said high frequency region includes frequencies in the approximate range 5 to 200 Hz.

5. The invention in claim 1 further characterized in that said means for eliminating amplitude modulations in the received signal includes an FM detector.

6. The invention in claim 1 further characterized in that said means for eliminating amplitude modulations in the received signal includes an amplitude limiter.

7. The invention in claim 1 and an alarm circuit operated by the output of said signal detection means when an output signal appears.

8. The invention in claim 1 characterized in that said signal processing means includes an integrator.

9. The invention in claim 1, characterized in that said signal processing means includes means for producing a first digital count proportional to the frequency of said received signal, means for producing a second digital count proportional to the frequency of said transmitted signal, means for subtracting one digital count from the other, and logic circuit means for recognizing the difference between said first and said second digital counts, and logic circuit characterized in that operation of an alarm circuit is initiated when said difference between said digital counts corresponds to a frequency difference between the received signal and transmitted signal greater than approximately 5 Hz.

10. The invention in claim 9 further characterized in that said logic circuit includes integrator means for discriminating against false alarms due to transients.

* * * * *